United States Patent [19]

Kemmner et al.

[11] 4,362,476

[45] Dec. 7, 1982

[54] SECURING APPARATUS FOR ELECTRIC FUEL PUMPS

[75] Inventors: Ulrich Kemmner, Sachsenheim; Karl Ruhl, Niefern, both of Fed. Rep. of Germany

[73] Assignee: Robert Bosch GmbH, Stuttgart, Fed. Rep. of Germany

[21] Appl. No.: 152,890

[22] Filed: May 23, 1980

[30] Foreign Application Priority Data

Jul. 14, 1979 [DE] Fed. Rep. of Germany ..... 2928469

[51] Int. Cl.[3] ..... F04B 17/00; F01D 5/10; F04D 29/60

[52] U.S. Cl. ..... 417/360; 417/363; 137/587

[58] Field of Search ..... 417/360, 363; 137/587; 55/204; 248/612, 613, 632, 634; 285/140

[56] References Cited

U.S. PATENT DOCUMENTS 4,212,600 7/1980 Otto et al. ..... 417/360

4,231,719 11/1980 Ringwald et al. ..... 417/360 X

*Primary Examiner*—Richard E. Gluck

*Attorney, Agent, or Firm*—Edwin E. Greigg

[57] ABSTRACT

A securing apparatus is proposed for electric fuel pumps intended for direct in-tank installation, which enables satisfactory removal of fuel vapor from the suction area of the pump, but prevents the transmission of vibration onto the fuel spinner fixedly mounted in the tank. This is accomplished in that the elastic properties of one or more rubber elements, directly connected in the form of sleeves to the pump, are maintained even with the effects of aging, since the rubber elements are primarily stressed only by shear or bending forces. The pump is inserted, with the mounted rubber element, into a corresponding device in the fuel spinner and, so far as this is necessary, secured with clamping elements. The rubber elements fulfill the functions of holding the pump, sealing the pump suction chamber from the tank, damping noise, and removing vapor in the tank.

15 Claims, 5 Drawing Figures

SECURING APPARATUS FOR ELECTRIC FUEL PUMPS

BACKGROUND OF THE INVENTION

The invention relates to a securing apparatus for electric fuel pumps intended for installation directly in the fuel tank, preferably in motor vehicles. Securing apparatuses for tank-installed pumps are known. Conventionally, they comprise a fuel spinner or roller secured in stationary fashion (on the floor of the tank, for instance) into which the electric fuel pump is inserted and held with the pumping portion at the bottom. The fuel spinner has a suction screen which, with sealing provided at all sides inside the fuel spinner, forms a suction basket. Thus only filtered fuel can be aspirated from the pump in order to prevent problems.

The electric fuel pump conventionally comprises a pumping portion and an electromotor driving it, the two portions being disposed in common in a housing; the fuel supplied under pressure can flow through the electromotor in order to cool it. Because an electric fuel pump of this kind is designed so that its supply quantity corresponds to maximum consumption, a fuel recirculation line is generally also provided, which leads from the carburetor or from the fuel injection area and is secured in a suitable manner on the fuel spinner, thus recirculating any excess hot fuel which may have been supplied.

If the electric fuel pump is supported in the fuel spinner indirectly by means of an interposed rubber element for the sake of avoiding noise buildup resulting from the transmission of sound through solids, then it is conventional to introduce a rubber sleeve of this kind into appropriate holder areas of the fuel spinner under pressure. The rubber or elastomeric material of the sleeve intended for decoupling in terms of vibrations is thus under a certain amount of pressure from the outset. Under the effects of swelling, which cannot be avoided over longterm use, this pressure is even further increased, so that the overall result is increasing rigidity in the pump support. Thus, securing the pump in this manner, despite the elastic properties originally present in the support, cannot assure a decoupling of the electric fuel pump relative to its support in the fuel spinner, the decoupling being understood in terms of a suppression of noise buildup resulting from the transmission of sound through solids. Furthermore, supporting an electric fuel pump in the fuel spinner in this manner, where the support is under the stress of pressure, is expensive in terms of both effort and cost.

OBJECTS AND SUMMARY OF THE INVENTION

The securing apparatus according to the invention having the characteristics of the main claim has the advantage over the prior art that the primary stress on the interposed rubber element holding the electric fuel pump inside the fuel spinner is exerted in the form of shear or bending forces. Accordingly, the elastic properties of the rubber element, or a sleeve made of some other, rubber-like or elastomeric material, can be exploited in optimal fashion. Because the rubber sleeve holding the electric fuel pump directly in the fuel spinner is inserted from the outset without pressure, even swelling which may occur later in the sleeve material does not cause an increase in rigidity or a resultant impairment of the initial, high-quality decoupling which exists between the electric fuel pump and the fuel spinner.

A further particular advantage is the ease of assembly, even in the swollen state, and the multiple function which the sleeve according to the invention and holding the electric fuel pump performs; specifically, the sleeve not only secures the pump but also serves to provide sealing of the suction basket and, as already mentioned, assures particularly good damping of vibration and therefore of noise.

It is finally also advantageous that the design and assembly of the securing apparatus according to the invention are simple and cost-favorable and that there is no impairment of the advantageous properties of the securing apparatus even with aging and possible swelling of the rubber sleeve.

As a result of the characteristics disclosed advantageous modifications of and improvements in the securing apparatus disclosed are possible. Of particular advantage is the satisfactory sealing of the suction basket area provided by an additional, annular plastic holder element, which is disposed between the actual fuel spinner area (made of sheet metal, for instance, and secured to the tank floor) and the rubber sleeve and which forms an annular chamber, widening toward the bottom in spiral fashion, for the recirculation of excess fuel quantities which may have been supplied.

The electric fuel pump is inserted, with a rubber element pushed onto it and in this sense preassembled, into a corresponding apparatus in the fuel spinner and is secured against both axial and rotary movement by clamping elements and by being pushed into place or as needed snapped into place.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
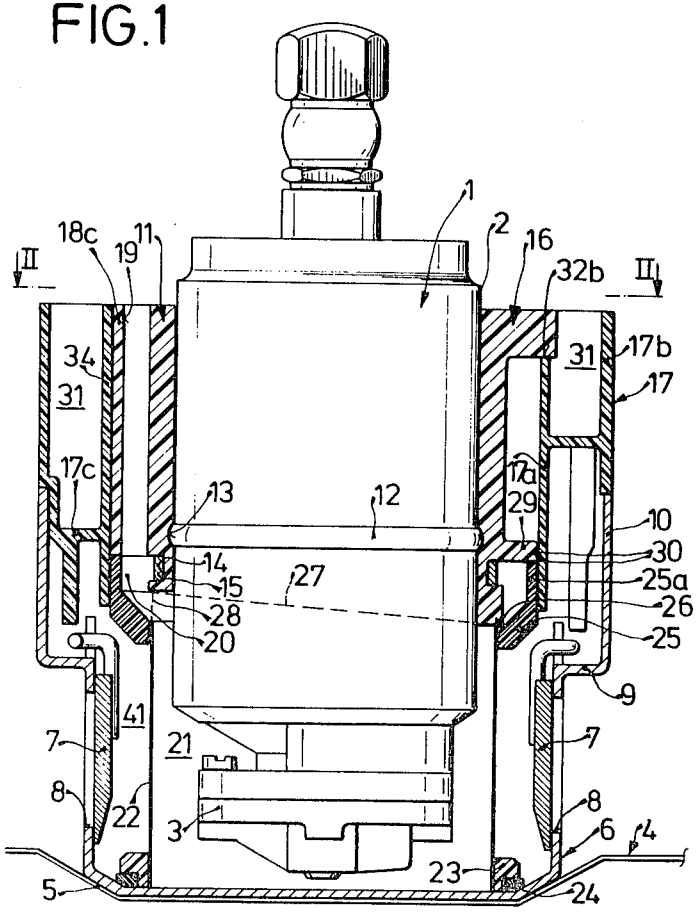
FIG. 1 is a lengthwise cross-sectional view of a first exempalry embodiment of a securing apparatus for electric fuel pumps in the case of installation directly in the tank.

In FIG. 1, the electric fuel pump, shown in elevation, is generally designated by reference numeral 1. It includes an external, substantially cylindrical housing 2 with a lower suction area 3 embodied as a part of the pump. The structure and shape of the particular electric fuel pump being used may be considered as arbitrary and known per se. In a depression of the tank floor 4, a first fuel spinner portion 6, preferably embodied as a sheet-metal part, is secured by means of suitable procedures, such as spot-welding, gluing, or the like. This first fuel spinner portion 6 has inlets 8, which are closed by means of flaps 7 and lead to the interior suction basket area (not a subject of the invention). Also, as shown in this view, the spinner portion 6 becomes wider toward the top, forming a step 9 on an annular reception and bearing wall 10.

For the purpose of supporting and holding the electric fuel pump 1 in the fuel spinner, the upper portion of the cylindrical housing wall of the electric fuel pump is first pushed into or surrounded by a holder sleeve resting in close contact with the electric fuel pump. It will be understood that the holder sleeve, although exclusively designated below as rubber element 11, may in principle be made of any desired material having elastic properties, so that rubber-like or elastomeric materials may be considered for the holder sleeve as well. In an efficient manner, the electric fuel pump 1 has a central annular bulge 12 protruding outward, which may serve as a stop during insertion into the rubber element 11 if the rubber element, as is preferable, has a complementary inner recess 13. Below the annular bulge 12, a clamping ring 14 can also be provided for the purpose of rotationally securing the pump inside the holder sleeve. The clamping ring 14 then rests in a complementary recess 15 of the rubber element 11. It will be understood that at this location the rubber element 11 embodying the holder sleeve may naturally be subject to pressure, that is, to compression stress, because the connection between the rubber element 11 and the electric fuel pump 1 should be as secure and reliable as possible at this location, while the supporting of the pump 1 with its surrounding rubber element or sleeve member 11 in holder elements of the fuel spinner or in an additional plastic element, which will be discussed directly below, must be effected such that the rubber element is subjected substantially only to shearing or bending stresses. In other words, it may be considered a primary proposition of the present invention that the support between the pump 1 and the rubber element 11 on the one hand and among fuel spinner portions on the other should be performed with an optimal exploitation of the elastic properties of the rubber element 11; that is, the pump should be suspended in the fuel spinner as gently as possible, thus providing maximum sound damping, while between the pump 1 and the fuel spinner (elements which by reason of their function inevitably cause vibrations) rigid transitions, or transitions capable of becoming rigid, must absolutely be avoided.

Figure 2:
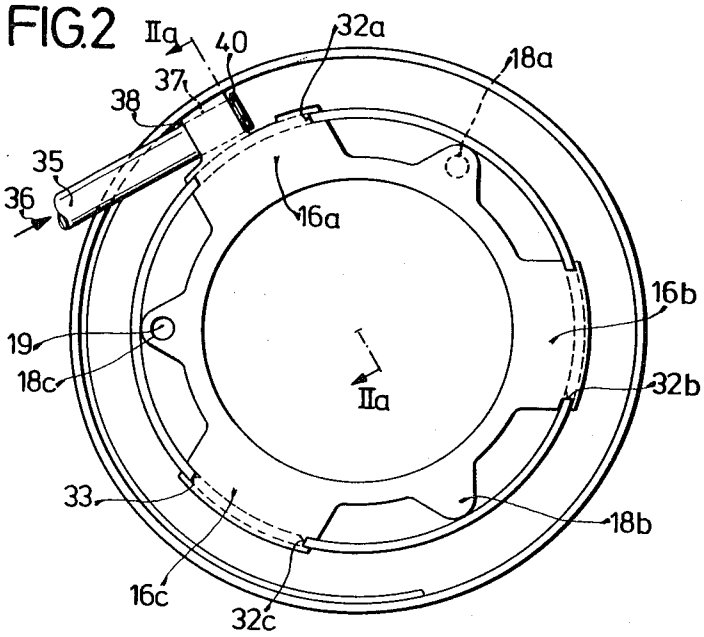
FIG. 2 is a view taken along the line II—II of FIG. 1.

For the purpose of supporting the pump 1 with the rubber element 11, the rubber element 11 has projections 16 on its rim; specifically, as shown in the plan view of FIG. 2, there are three projections 16*a*, 16*b*, 16*c* distributed uniformly about the circumference. It will be understood, however, that these projections may also be differently shaped and different in number, and in some cases may even be disposed as a closed ring on the circumference of the rubber element 11; they need be embodied only such that they can serve to provide free suspension of the pump 1 in the fuel spinner, without the rubber element being under compression stress in this specialized suspension area (that is, in the area of transition between the pump 1 and the fuel spinner).

In the illustrated exemplary embodiment the projections 16 are embodied as outwardly directed tongues integral with the rubber element 11 and distributed uniformly about the circumference in the upper portion of the rubber element. The result is various outwardly protruding annular segments which serve to secure or anchor the pump 1 in the fuel spinner. In one embodiment of the invention, the fuel spinner area which actually supports the projections 16 of the rubber element 11 comprises a double-walled intermediate element 17 made of plastic, which is placed upon the upper wall 10 of the lower fuel spinner portion 6 and is pushed into place therein; it will be appreciated, however, that the fuel spinner as a whole may also be embodied in one piece. The inclusion of the intermediate element 17 in a preferred exemplary embodiment of the invention is useful, however, because the introduction of the recirculation line may necessitate a possibly complicated shape, and this can be realized more simply when the intermediate element 17 is a plastic part, manufactured by extrusion molding, for instance, or in some other manner.

As the form of embodiment of FIG. 2 shows, between the three tongues 16*a*, 16*b*, 16*c* present in this embodiment and serving to secure and hold the rubber element 11 with the pump 1 there are three further, outwardly protruding lengthwise ribs 18*a*, 18*b*, 18*c*, at least one of which (specifically, in this exemplary embodiment, the rib 18*c*) has a central bore 19, which is also shown in FIG. 1 and communicates via a connection channel area 20 with the interior 21 of the suction basket. It is thereby possible to provide the important capability of removing fuel vapor bubbles from the sealed suction area. This removal of fuel vapor bubbles is the precondition for attaining an improvement in hot-gasoline supply by means of installing an electric fuel pump in the fuel tank. The sealed suction area of the pump, containing only filtered fuel, is surrounded in the exemplary embodiment of FIG. 1 by fine-mesh sieves to form a suction basket, e.g. an annular sieve 22, which rests at the bottom in a suitable holder ring 23 which may be of plastic. Sealing is effected at the bottom by means of a rubber ring 24, made of foam rubber, for instance. At the top, the sieve rests in a sealing manner against a plastic ring 25 which has not previously been mentioned, and which is inserted from the inside toward the outside; specifically, in the illustrated exemplary embodiment, it is pushed from the inside with an outer annular flange 25*a* into an inner cylindrical wall area 17*a* of the plastic intermediate element 17. From the annular flange 25 located close to the inner wall 17*a* of the intermediate element 17, the plastic ring 25 serving to seal the suction basket tapers inward and at 26 it can also form an inner, annular contact shoulder, on which a lower annular area of the rubber element 11 is seated. In any event, the lower area of the rubber element 11 which is secured by the clamping ring 14 extends obliquely upward as indicated by broken lines at 27, so that for the interior 21 of the suction basket an opening in the intermediate channel 20 remains free at 28, which in combination with the bore 19 serves to carry away fuel vapor bubbles.

Further sealing of the suction basket or support of the rubber element 11 on the inner wall 17*a* of the double-walled intermediate element 17 can also be provided by an outwardly protruding annular flange 29 disposed in the lower portion of the rubber element 11 and extending continuously or with interruptions around the circumference. This annular flange 29 rests against both the inner wall 17*a* of the intermediate element 17 and the ring 25. These areas, which are marked by reference numeral 30 in FIG. 1, accordingly serve, in combination with the stop of the rubber element 11 on the inwardly directed shoulder 26 of the ring 25, to provide effective suction basket sealing.

It has already been noted that the intermediate element 17 is made of plastic and embodied as double-walled; the outer wall is marked 17*b*. Between the walls 17*a*, 17*b* of the intermediate element 17 there is a connecting base 17*c*, which gradually drops downward in spiral fashion, so that the intermediate element 17 forms an annular channel 31, open at the top and dropping downward in spiral fashion, which serves to receive the recirculated fuel. As a result of this spiral introduction of the recirculated fuel into the fuel spinner area, the fuel is given an opportunity to give up dissolved gases, and any gas bubbles which form can escape freely upward out of the annular channel 31. The manner of securing the recirculation line will be discussed further below.

In a preferred embodiment of the present invention, the outwardly protruding holder tongues 16*a*, 16*b*, 16*c* of the rubber element 11 are secured in recesses 32*a*, 32*b*, 32*c* of the inner wall 17*a* of the intermediate element 17 and the tongues 16*a*, 16*b*, 16*c* are of a length such that they rest on the base of the recesses 32*a*, 32*b*, 32*c* of the inner wall 17*a*.

In a further advantageous embodiment and for the purpose of axially securing the connection between the protruding rubber tongues 16*a*, 16*b*, 16*c* on the rubber element 11 and the plastic intermediate element 17 supporting and carrying them, a sort of dovetail fastening is provided between them such that, as FIG. 2 shows more precisely, the tongues 16*a*, 16*b*, 16*c* have recess-like grooves 33, preferably at either side, which are engaged compactly by rim areas of the recesses 32*a*, 32*b*, 32*c* protruding outward laterally at either side. Although because of this tight, compact connection an axial securing of the pump 1 with the rubber element 11 against slipping upward out of position is attained as a result of friction and based on the overlapping dovetail connection, the rubber element 11 supporting the pump 1 is still not subjected to compression stresses, because the entire central portion of the protruding tongues 16*a*, 16*b*, 16*c* can expand freely, even under the effect of swelling caused by aging. On the other hand, the dovetail connection naturally effects satisfactory rotary securing in addition to the axial support. The radial support of the pump 1 with the rubber element 11 in the fuel spinner area is substantially attained by means of the lengthwise ribs 18*a*, 18*b*, 18*c*, which, as indicated at 34, are supported over their entire length on the inner wall 17*a* of the intermediate element 17. One or more of these lengthwise ribs may contain degassing channels or bores 19 for satisfactory removal of fuel vapor. The lengthwise ribs 18*a*, 18*b*, 18*c* narrow toward the outside and assure gentle support without compression.

Furthermore, between the plastic elements substantially effecting the sealing of the suction basket, namely, the upper ring 25 and the lower ring 23, connection ribs or connection struts can be provided, which are not shown in FIG. 1, if sufficient rigidity cannot be attained otherwise. The pump 1, which may under some circumstances have substantial weight (up to approximately 1 kg), is supported gently and free to swing in any event, with optimal exploitation of the elastic properties of the rubber element 11 in the fuel spinner basket thus embodied.

Figure 2A:
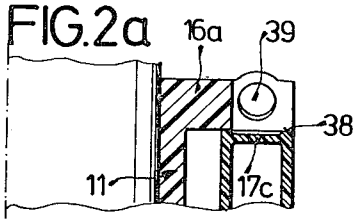
FIG. 2*a* is a detailed sectional illustration of the reception area for the recirculation line as a partial section taken along the line II*a*—II*a* of FIG. 2.

As shown by FIG. 2*a* in connection with FIG. 2, the recirculation line 35, in which the recirculated fuel flows as indicated by the arrow 36, can be held in an extension 37 carried out to the outer wall 17*b*; here, this is an extension 37 of the supporting tongue 16*a* of the rubber element 11. This extension 37 may rest in a recess opening 38 of the outer wall 17*b* of the intermediate element 17 and has an inner opening 39, into which the end piece of the recirculation line 35, provided with an enlarged annular bulge 40, is pushed under a certain amount of pressure. Because of the annular bulge 40, secure anchoring of the recirculation line 35 is provided at this location, at which furthermore the connection base 17*c* attains its highest position between the two annular walls 17*a*, 17*b* of the intermediate element 17, as FIG. 2*a* shows. From this point, this intermediate base 17*c* drops in spiral fashion, as shown in FIG. 1, extending in the clockwise direction circumferentially between the two annular walls of the intermediate element 17, finally discharging into an annular chamber 41 located ahead of the actual suction chamber 21. Because of the spiral expulsion of the recirculated fuel into the annular channel 31, effective degassing is attained, and fuel vapor bubbles can flow freely upward.

Figure 3:
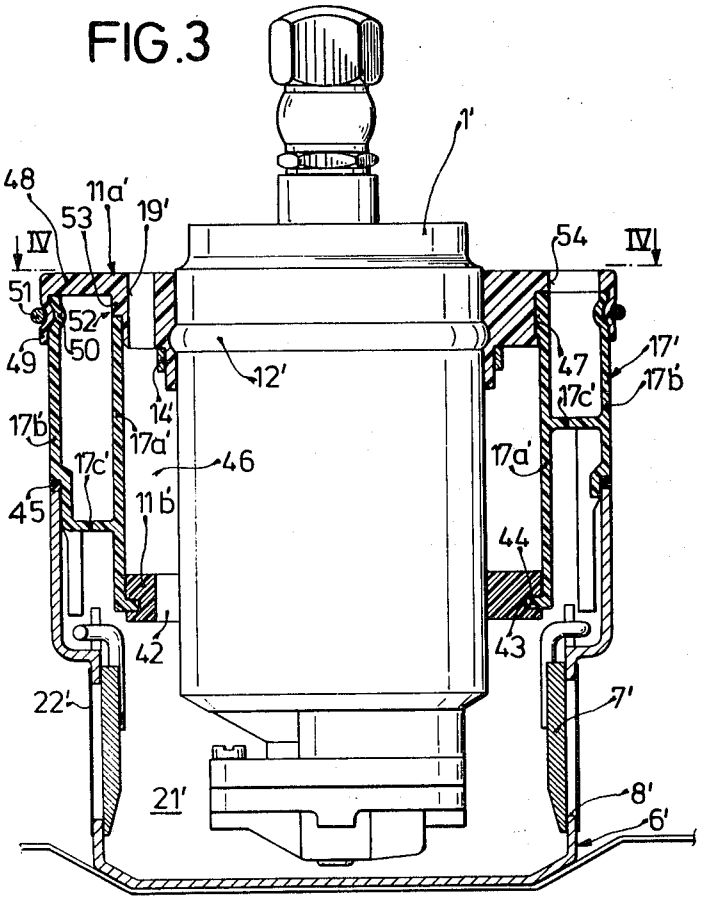
FIG. 3 is a lengthwise cross-sectional view of a second exemplary embodiment of a securing apparatus for electric fuel pumps.

In the further exemplary embodiment of the present invention shown in FIGS. 3 and 4, the properties which are essential for realizing the invention and which have already been discussed in connection with FIGS. 1 and 2 are maintained, although in a partially different from an embodiment. Specifically, these are: that stress on the rubber element 11*a*', 11*b*' which surrounds the pump 1' over its circumference is exerted primarily in the form of shearing and bending forces; there is optimal exploitation of its elastic properties; assembly is simple, even in the swollen state; little compression of the rubber element occurs; and the rubber element is used to fulfill multiple functions, that is, sealing and securing as well as providing high-quality vibration damping and accordingly noise damping. In the exemplary embodiment shown in FIG. 3, the rubber element is divided into two parts, namely an upper rubber ring element 11*a*' whose form is somewhat more complicated and a lower rubber ring 11*b*'. The lower rubber ring 11*b*' which serves solely as a radial support of the pump 1', has at least one passageway 42 for fuel vapor bubbles and is seated, with a radial groove 43, in an inwardly protruding annular flange 44 of the inner annular wall portion 17*a*' of the intermediate element 17' (here again preferably of plastic) and is held there as a result. As may be seen from the drawing, here as well the intermediate base 17*c*' drops gradually downward between the inner and outer walls 17*a*', 17*b*' of the intermediate element 17', forming a spiral inlet and degassing channel for the recirculated fuel.

A further difference from the exemplary embodiment of FIG. 1 is that the inner suction basket area 21' and the area into which the recirculated fuel is at first directed in the embodiment of FIG. 1 are no longer embodied separately; the fine-meshed sieves 22' which separate the suction chamber 21' from the surrounding tank area are here attached directly to and over the inlet openings 8', which are embodied directly by the lower fuel spinner portion 6' and closed by flaps 7', which naturally can easily be opened inward by the entering fuel. Accordingly it is also necessary to attach a further sieve, not visible in FIG. 3, on the end of the inlet spiral embodied by the annular channel for the recirculated fuel to act as a bubble filter. Because the entire inner portion of the fuel spinner is simultaneously embodied as the interior 21' of the suction basket, an additional seal 45 is also disposed here in the transition area between the intermediate element 17', namely its outer wall 17*b*', and the annular face, open at the top, of the lower fuel spinner portion 6'. The outer wall area 17b' of the intermediate element 17' is seated, forming a shoulder, on the annular opening of the lower fuel spinner portion 6' and is pushed partway into this portion 6'.

The actual support of the pump 1' against axial displacement is effected here as well with the aid of a clamping ring 14', which firmly connects the upper rubber element ring 11'a with the pump 1' in the area of an annular bulge 12' of the pump 1'. However, the annular bulge 12; and the clamping ring 14', with only a limited lengthwise extension of the upper rubber element portion 11'a, are disposed very far inside the upper pumping portion 1', so that it is possible to form a vapor collection chamber 46 of large volume between the lower rubber ring 11'b and the upper rubber element ring 11'a, this chamber 46 having a discharge channel 19' in the upper rubber element ring 11'a for carrying away any fuel bubbles formed.

The upper rubber element ring 11a' is embodied such that it first bridges over the distance between the upper circumference of the pump and the inner annular wall 17'a of the intermediate element 17' and, forming a sealing face 47, comes to rest against this element 17' as a stop. At the top, the rubber element ring 11'a is continued, protruding outwardly in platform fashion, and extends over the two upper annular faces which are embodied by the walls 17'a and 17'b. Finally, an apron-like appendage 49 extends downward from the annular plate 48 of the rubber element ring 11'a and is held by a clamping ring 51, secure from rotation, in an inwardly directed annular groove 50 in the outer wall 17'b of the intermediate element 17'. Thus satisfactory axial support is attained, and the rotational security can be still further increased in that, as indicated at 52, protruding tongues 53 can engage partial openings, which are further recessed toward the bottom, of the inner annular wall 17'a of the intermediate element 17', just as has already been shown for the tongues 16a, 16b, 16c in the exemplary embodiment of FIGS. 1, 2.

Figure 4:
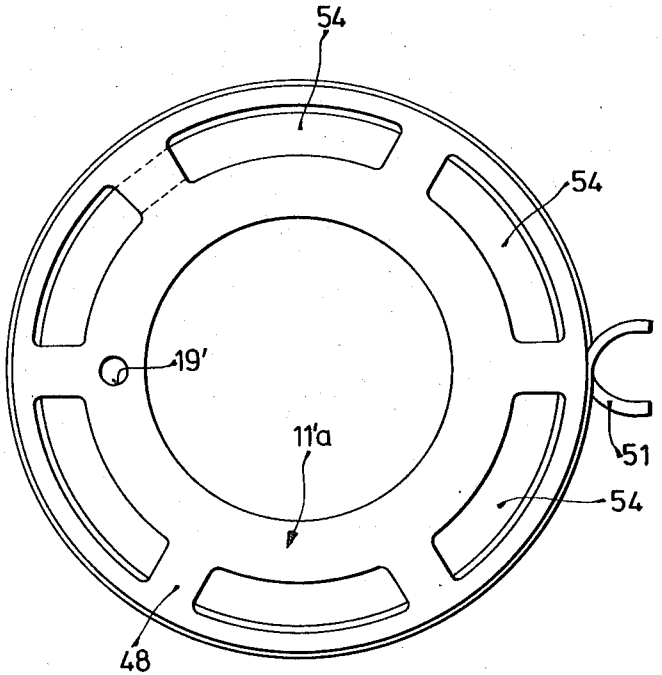
FIG. 4 is a view taken along the line IV—IV of FIG. 3.

FIG. 4 shows that the upper annular plate 48 of the upper rubber element ring 11'a has windows 54, so that escaping fuel vapor bubbles can be removed upward, out of the inlet spiral for recirculated fuel. Accordingly, it can also be said that the upper rubber element ring 11'a is formed by an inner annular structure, which is disposed for the purpose of radial support and radial sealing between the upper, outer circumference of the pump 1' and the inner wall 17a', and by an outer ring, which is fixed to the outer wall 17b' of the intermediate element 17' and connected with the inner annular structure via connecting tongues, which extend over the annular channel, forming the inlet spiral, for the recirculated fuel.

In assembling the pump 1' for installation in the fuel tank, the procedure may be as follows: the pump is preassembled with its rubber element 11 or 11a', 11b' which primarily supports it and then, with the plastic intermediate element 17, 17' secured directly on the rubber element, the pump is introduced into the lower fuel spinner portion 6, 6' which is fixedly installed in the tank, if necessary with compression being present between the plastic element 17, 17' and the lower fuel spinner portion 6, 6'.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A securing apparatus for an electric fuel pump, comprising a lower pumping portion and a combined electromotor arranged for direct installation in fuel tanks of motor vehicles and the like, said apparatus further including a fuel spinner fixedly mounted in a suction area in the fuel tank, and thereby arranged to form a suction basket separated from the remaining tank area by sieve means, said fuel spinner including a lowered element an intermediate element secured on the lowered element, said intermediate element having recesses therein, a sleeve member of rubber-like or elastomeric material arranged to encompass a portion of said pump and is secured thereon, said sleeve member secured on said pump includes equally spaced radially outwardly protruding projections at the top thereof which engage and are supported by said recesses in said intermediate element of said fuel spinner whereby said sleeve member is secured on said intermediate element in such a manner that said sleeve is stressed primarily by shear and bending forces.

2. A securing apparatus as defined by claim 1, characterized in that said sleeve member further includes an inner cylindrical portion which rests against an upper terminal wall of said intermediate portion of said fuel spinner, said terminal wall and said inner cylindrical portion having cooperative means arranged to prevent rotation of said pump.

3. A securing apparatus as defined by claim 1, characterized in that said intermediate element includes inner and outer walls, said outer wall being seated on said lowered element of said fuel spinner.

4. A securing apparatus as defined by claim 3, characterized in that said intermediate element is constructed of plastic and said lowered element of said fuel spinner is constructed of sheet metal.

5. A securing apparatus as defined by claim 4, characterized in that said plastic intermediate element further includes an intermediate base element arranged to connect the outer wall with the inner wall thereof, said intermediate base element further having an annular descending spiral wall for recirculated fuel.

6. A securing apparatus as defined by claim 3, characterized in that said suction basket includes upper and lower ring means, said upper ring arranged to rest with an axial flange against said inner wall of said intermediate element.

7. A securing apparatus as defined by claim 6, characterized in that said upper and lower rings are interconnected by strut means.

8. A securing apparatus as defined by claim 3, characterized in that said sleeve member further includes a rubber element having a radial flange arranged to rest against said inner wall of said intermediate element and a ring disposed on said suction basket.

9. A securing apparatus as defined by claim 1, characterized in that said sleeve member includes molded ribs which extend lengthwise of said pump, at least one of said ribs further including a passage channel in communication with said suction basket for degassing the interior thereof.

10. A securing apparatus as defined by claim 1, characterized in that said pump and said sleeve member are supported relatively immovably in said intermediate element of said fuel spinner.

11. A securing apparatus as defined by claim 10, characterized in that said intermediate element of said fuel spinner has an outermost wall and at least one of said projections is extended into contact therewith, said at least one projection arranged to support a fuel recirculation line.

12. A securing apparatus as defined claim 1, characterized in that said pump and said sleeve member are provided with complementally formed means, said means capable of preventing axial movement of said pump relative to said sleeve member.

13. A securing apparatus as defined by claim 1, characterized in that said sleeve member comprises a lower ring and an upper ring and said lower ring arranged to be held by a radially inwardly protruding annular flange on an inner wall of said fuel spinner.

14. A securing apparatus as defined by claim 13, characterized in that said upper ring is secured to said pump by means of a clamping ring, said clamping ring further including means formed complementally to said pump for preventing axial movement thereof, said upper ring further including a downwardly extending apron, said apron being secured to said fuel spinner by a further clamping means.

15. A securing apparatus as defined by claim 2, characterized in that said sleeve member further includes an apertured closure member to provide for emission of fuel vapor bubbles from an area into which said pump is arranged to extend.

* * * * *